US008495979B2

(12) United States Patent
Arvan

(10) Patent No.: US 8,495,979 B2
(45) Date of Patent: Jul. 30, 2013

(54) ROCKER ARM ASSEMBLY FOR INTERNAL COMBUSTION ENGINE

(75) Inventor: Gary J. Arvan, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/288,311

(22) Filed: Nov. 3, 2011

(65) Prior Publication Data

US 2012/0266836 A1 Oct. 25, 2012

Related U.S. Application Data

(60) Provisional application No. 61/478,645, filed on Apr. 25, 2011.

(51) Int. Cl.
*F01L 1/18* (2006.01)

(52) U.S. Cl.
USPC ..... 123/90.39; 123/90.16

(58) Field of Classification Search
USPC ..... 123/90.39, 90.16; 74/559, 569
See application file for complete search history.

(56) References Cited

U.S. PATENT DOCUMENTS 4,593,662 A * 6/1986 Baring et al. ..... 123/198 F

* cited by examiner

*Primary Examiner* — Zelalem Eshete
(74) *Attorney, Agent, or Firm* — Cantor Colburn LLP

(57) ABSTRACT

An internal combustion engine comprising valve sets through which combustion air enters a cylinder is mixed with fuel for combustion therein and through which products of combustion exit. A valve train assembly comprises a drive rocker arm, including a first, proximal end in contact with a rotatable camshaft and a second, distal end in contact with a valve shaft of a first valve of a valve set and a driven rocker arm including a first, proximal end in contact with the drive rocker arm at a location that is adjacent to the first, proximal end thereof and a second, distal end in contact with a valve shaft of a second valve of a valve set. The drive rocker arm and the driven rocker arm operate to move the valves reciprocally from a closed to an open position.

19 Claims, 2 Drawing Sheets

ROCKER ARM ASSEMBLY FOR INTERNAL COMBUSTION ENGINE

CROSS-REFERENCES TO RELATED APPLICATIONS

This patent application claims priority to U.S. Patent Application Ser. No. 61/478,645 filed Apr. 25, 2011 which is hereby incorporated herein by reference in its entirety.

FIELD OF THE INVENTION

Exemplary embodiments of the invention relate to valve train assemblies for internal combustion engines and, more particularly, to a rocker arm configuration therefore.

BACKGROUND

With reference to FIGS. 1 and 4, the actuation of intake and exhaust valves 12 and 14 respectively, in a 4-valve per cylinder internal combustion engine 10, particularly a diesel engine, may require the use of a valve bridge 16 due to various design constraints such as actuation type, valve location, cylinder and/or cylinder head configuration, fuel injector location, or a combination thereof. A valve bridge 16 is a device that spans the distance between and contacts two valves, either intake or exhaust, any has a contact point roughly equidistant from the centerline of both valves. The valve bridge 16 is used as a location for actuation of the valve set by a rocker arm 18.

A common issue with a valve bridge system of the type just described is that various tolerances and operating parameters such as valve length, valve seat configuration, valve spring height and rate or a combination thereof may result in one valve opening and/or closing at a different time than the other valve in a set. As a result, the profile of the cam actuator must be designed with longer and higher ramps to avoid high contact velocities between the valves 12, 14 and their respective valve seats. Such long ramps compromise engine breathing, resulting in reduced power, reduced torque and increased emissions.

SUMMARY

An internal combustion engine comprising a cylinder having a piston disposed for reciprocation therein, valve sets through which combustion air enters the cylinder is mixed with fuel for combustion therein and through which products of combustion exit the cylinder and a valve train assembly, configured to assure the proper opening and closing of the valve sets. The valve train assembly comprises a drive rocker arm, including a first, proximal end in contact with a rotatable camshaft and a second, distal end in contact with a valve shaft of a first valve of a valve set and a driven rocker arm including a first, proximal end in contact with the drive rocker arm at a location that is adjacent to the first, proximal end thereof and a second, distal end in contact with a valve shaft of a second valve of a valve set. The drive rocker arm and the driven rocker arm operate to move the valves reciprocally from a closed to an open position along a valve shaft axis of each valve.

BRIEF DESCRIPTION OF THE DRAWINGS

Other objects, features, advantages and details appear, by way of example only, in the following detailed description of the embodiments, the detailed description referring to the drawing in which.

DESCRIPTION OF THE EMBODIMENTS

Figure 1:
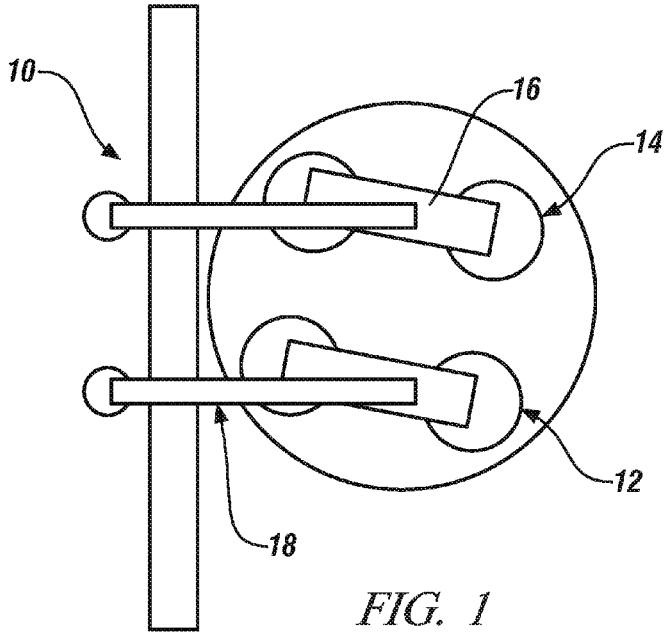
FIG. 1 is a partial schematic view of an internal combustion engine having a valve train assembly utilizing a known valve bridge system.

The following description is merely exemplary in nature and is not intended to limit the present disclosure, its application or uses. It should be understood that throughout the drawings, corresponding reference numerals indicate like or corresponding parts and features.

Figure 2:
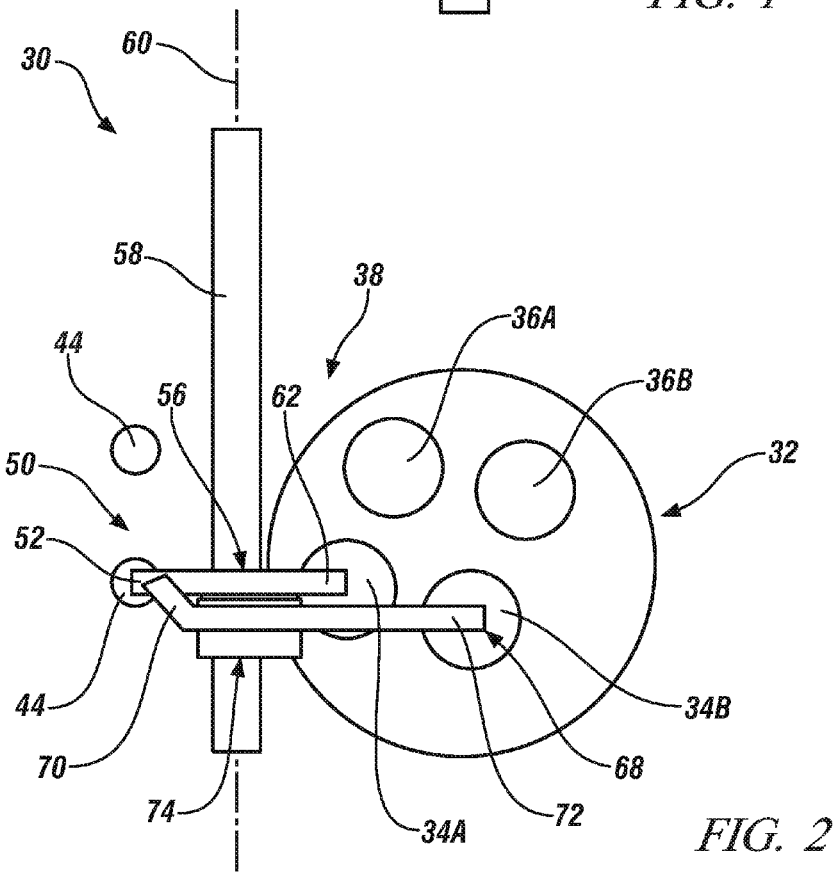
FIG. 2 is a partial schematic plan view of an internal combustion engine having a valve train assembly embodying features of the invention.
Figure 3:
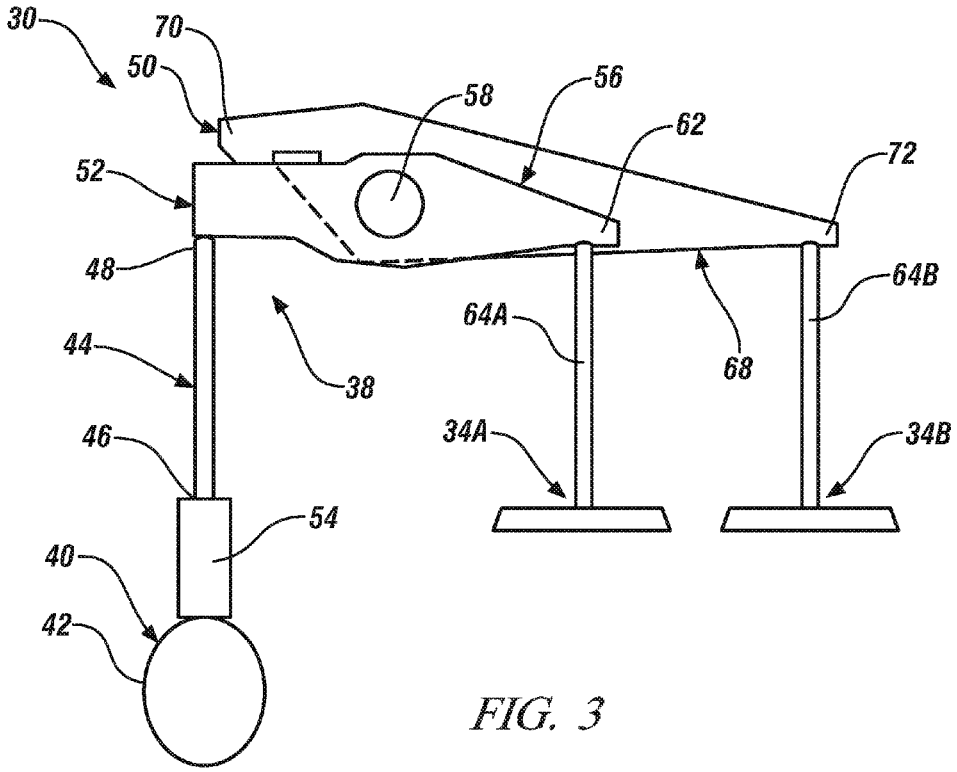
FIG. 3 is a partial schematic side view of the internal combustion engine of FIG. 2 embodying features of the invention.

Referring to FIGS. 2 and 3, an internal combustion engine 30 includes one or more cylinders 32 that receive a piston (not shown) for reciprocation therein. Combustion air enters the cylinders 32 through intake valve sets 34 (first intake valve 34A and second intake valve 34B) and is mixed with fuel for combustion therein. The products of combustion exit the cylinders 32 through exhaust valve sets 36 (first exhaust valve 36A and second exhaust valve 36B), and the cycle is repeated.

Regulation of the intake and exhaust valve sets 34, 36 is through a valve train assembly 38 that is configured to assure the proper opening and closing of the valves including speed, lift and timing. In an exemplary embodiment, the valve train assembly 38 may comprise one or more rotatable camshafts 40 having eccentric cams 42 disposed thereon. In the embodiment illustrated, a push rod 44 has a first end 46 in communication with the surface of the cam 42 and a second end 48 in communication with a first, proximal end 52 of a rocker arm assembly 50 thereby connecting the cam with the rocker arm assembly. A hydraulic element 54 may be disposed between the push rod 44 and the cam 42 or the rocker arm assembly 50 and accounts for any misadjustment or wear ("valve lash") between the various components during operation of the internal combustion engine 10.

Figure 4:
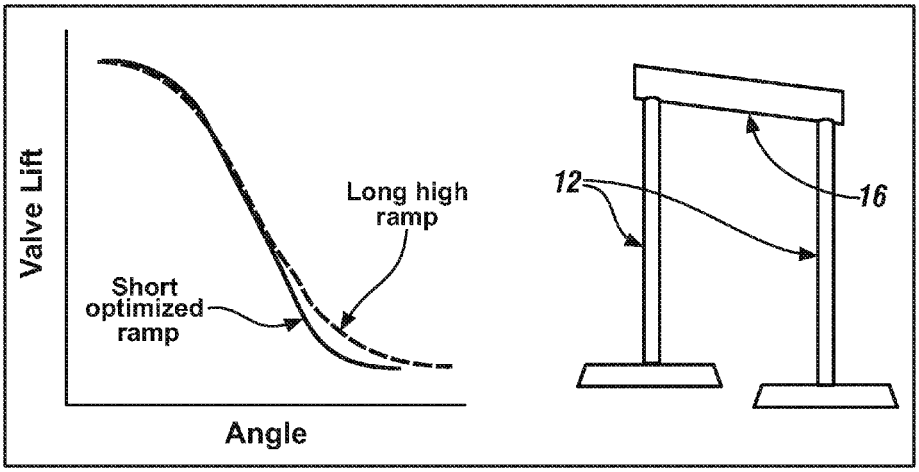
FIG. 4 illustrates additional detail of the internal combustion engine of FIG. 1.

In an exemplary embodiment, the rocker arm assembly 50 includes a drive rocker arm 56, including the first, proximal end 52 in contact with the push rod 44 that is mounted on a rocker shaft 58 for rotation about the axis 60 thereof. A second, distal end 62 of the drive rocker arm 56 is in contact with the valve shaft 64A of the intake valve 34A and operates, through rotation about the rocker shaft axis 60 to move the valve reciprocally from a closed to an open position along the valve shaft axis. A driven rocker arm 68 includes a first, proximal end 70 that is in contact with the drive rocker arm 56 at a location that is adjacent to the first, proximal end 52 thereof. The driven rocker arm 68 may also be mounted on rocker shaft 58 for rotation about the axis 60 thereof. A second, distal end 72 of the driven rocker arm 68 is in contact with the valve shaft of the intake valve 34B and operates, through rotation about the rocker shaft axis 60 to move the valve reciprocally from a closed to an open position along the valve shaft axis. In exemplary embodiments, the drive rocker arm 56 and the driven rocker arm 68 may be individual components with the driven rocker arm actuated by the drive rocker arm as illustrated in FIG. 3. Optionally, the drive rocker arm and the driven rocker arm may be fixed together or constructed as a single component to form the rocker arm assembly 50. A hydraulic element may be located between the drive and the driven rocker arms 56 and 68 to account for any lash between the two components during operation of the internal combustion engine 30. In an exemplary embodiment, if the drive rocker arm 56 and the driven rocker arm 68 are both mounted to the rocker shaft 58, a non-concentric bushing 74 (FIG. 2.) may be used at either the drive or the driven pivot to adjust the rocker arm assembly 50 to the desired valve lift ratios (shorter, optimized ramp as illustrated in FIG. 4). It is contemplated that the rocker shaft 58 may be dispensed with and the drive rocker arm 56 and the driven rocker arm 68 may be pivotally mounted on individual pedestal mounts (not shown). In either configuration the rocker arm assembly 50 may be configured to provide either equal or different openings for each valve 34A & 34B, however opening and closing of the valves will occur simultaneously. For descriptive simplicity, the valve train assembly 38 embodying the invention has been illustrated and described with respect to intake valves 34; however the valve train assembly has equal application to the operation of exhaust valves 36 without varying from the scope of the invention. Additionally, while the valve train assembly 38 embodying the invention has been illustrated and described with respect to its operation in an internal combustion engine having push rods 44 for valve actuation, it is contemplated that the invention has equal application to an overhead cam to rocker arm valve train assembly without deviating from the scope of the invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the application.

What is claimed is:

1. An internal combustion engine comprising:

a cylinder having a piston disposed for reciprocation therein;

valve sets through which combustion air enters the cylinder is mixed with fuel for combustion therein and through which products of combustion exit the cylinder;

a valve train assembly, configured to assure a proper opening and closing of the valve sets and comprising:

a drive rocker arm, including a first, proximal drive rocker arm end in contact with a rotatable camshaft and a second, distal drive rocker arm end in contact with a valve shaft of a first valve of a valve set; and a driven rocker arm including a first, proximal driven rocker arm end in contact with the drive rocker arm at a location on the drive rocker arm that is adjacent to the first, proximal drive rocker arm end and a second, distal driven rocker arm end in contact with a valve shaft of a second valve of a valve set, the drive rocker arm and the driven rocker arm operable to move the valve sets reciprocally from a closed to an open position.

2. The internal combustion engine of claim 1, further comprising a push rod extending between the first, proximal drive rocker arm end and the rotatable camshaft.

3. The internal combustion engine of claim 1, wherein the drive rocker arm and the driven rocker arm are individual components with the driven rocker arm actuated by the drive rocker arm.

4. The internal combustion engine of claim 1 wherein the drive rocker arm is mounted, between the first, proximal drive rocker arm end and the second, distal drive rocker arm end, on a first rocker shaft for rotation about a first rocker shaft axis thereof and operates, through rotation about the first rocker shaft axis, to move a valve.

5. The internal combustion engine of claim 1 wherein the driven rocker arm is mounted, between the first, proximal driven rocker arm end and the second, distal driven rocker arm end, on a second rocker shaft for rotation about a second rocker shaft axis thereof and operates, through rotation about the second rocker shaft axis, to move a valve.

6. The internal combustion engine of claim 1, wherein the drive rocker arm and the driven rocker arm comprise a single component.

7. The internal combustion engine of claim 1 wherein the drive rocker arm is pivotally mounted, between the first, proximal drive rocker arm end and the second, distal drive rocker arm end, on an individual pedestal mount for rotation about an axis thereof and operates, through rotation about the axis, to move a valve.

8. The internal combustion engine of claim 1 wherein the driven rocker arm is pivotally mounted, between the first, proximal driven rocker arm end and the second, distal driven rocker arm end, on an individual pedestal mount for rotation about an axis thereof and operates, through rotation about the axis, to move a valve.

9. The internal combustion engine of claim 1 wherein:

the drive rocker arm is mounted, between the first, proximal drive rocker arm end and the second, distal drive rocker arm end, on a drive rocker shaft for rotation about a drive rocker shaft axis thereof and operates, through rotation about the drive rocker shaft axis, to move a valve; and wherein the driven rocker arm is mounted, between the first, proximal driven rocker arm end and the second, distal driven rocker arm end, on a driven rocker shaft for rotation about a driven rocker shaft axis thereof and operates, through rotation about the driven rocker shaft axis, to move a valve.

10. The internal combustion engine of claim 9, wherein the drive rocker shaft and the driven rocker shaft are co-axial.

11. The internal combustion engine of claim 10, wherein the drive rocker shaft is the driven rocker shaft.

12. The internal combustion engine of claim 10, further comprising a hydraulic element located between the drive rocker arm and the driven rocker arm to compensate for lash between the drive rocker arm and the driven rocker arm during operation.

13. The internal combustion engine of claim 1 wherein:

the drive rocker arm is mounted, between the first, proximal drive rocker arm end and the second, distal drive rocker arm end, on an eccentric bushing about a drive rocker shaft for eccentric rotation about a drive rocker shaft axis thereof and operates, through rotation about the drive rocker shaft axis, to move a valve; and wherein the driven rocker arm is mounted, between the first, proximal driven rocker arm end and the second, distal driven rocker arm end, on a driven rocker shaft for rotation about a driven rocker shaft axis thereof and operates, through rotation about the driven rocker shaft axis, to move a valve.

14. The internal combustion engine of claim 1 wherein:

the drive rocker arm is mounted, between the first, proximal drive rocker arm end and the second, distal drive rocker arm end, on a drive rocker shaft for rotation about a drive rocker shaft axis thereof and operates, through rotation about the drive rocker shaft axis, to move a valve; and wherein the driven rocker arm is mounted, between the first, proximal driven rocker arm end and the second, distal driven rocker arm end, on an eccentric bushing about a driven rocker shaft for eccentric rotation about a driven rocker shaft axis thereof and operates, through rotation about the driven rocker shaft axis, to move a valve.

15. The internal combustion engine of claim 1, wherein the valve train assembly is configured to provide simultaneous, yet unequal, opening of the first valve and the second valve.

16. A valve train assembly for an internal combustion engine comprising:

a drive rocker arm, including a first, proximal drive rocker arm end in contact with a rotatable camshaft and a second, distal drive rocker arm end in contact with a valve shaft of a first valve of a valve set; and a driven rocker arm including a first, proximal driven rocker arm end in contact with the drive rocker arm at a location on the drive rocker arm that is adjacent to the first, proximal drive rocker arm end and a second, distal driven rocker arm end in contact with a valve shaft of a second valve of a valve set, the drive rocker arm and the driven rocker arm operable to move the valve set reciprocally from a closed to an open position, wherein the a valve train assembly is configured to assure simultaneous opening and closing of the valve set.

17. The valve train assembly of claim 16, wherein the drive rocker arm and the driven rocker arm are individual components with the driven rocker arm actuated by the drive rocker arm.

18. The valve train assembly of claim 16, wherein the drive rocker arm is mounted, between the first, proximal drive rocker arm end and the second, distal drive rocker arm end, on a rocker shaft for rotation about a rocker shaft axis thereof and operates, through rotation about the rocker shaft axis, to move a valve.

19. The valve train assembly of claim 16, wherein the drive rocker arm and the driven rocker arm comprise a single component.

* * * * *